United States Patent [19]

Wotring

[11] Patent Number: 5,005,990

[45] Date of Patent: Apr. 9, 1991

[54] PUMP BEARING SYSTEM

[75] Inventor: Timothy L. Wotring, Emmaus, Pa.

[73] Assignee: Ingersoll-Rand Company, Woodcliff Lake, N.J.

[21] Appl. No.: 516,039

[22] Filed: Apr. 27, 1990

[51] Int. Cl.[5] ..... F16C 33/74; F04D 29/08

[52] U.S. Cl. ..... 384/130; 384/144; 415/111

[58] Field of Search ..... 384/124, 130, 131, 132, 384/138, 144; 415/110–112

[56] References Cited

U.S. PATENT DOCUMENTS

| | | | |
|---|---|---|---|
| 3,620,639 | 11/1971 | Gaffal et al. | 415/111 |
| 3,652,186 | 3/1972 | Carter | 415/110 X |
| 3,676,011 | 7/1972 | Reif | 415/111 |
| 3,749,464 | 7/1973 | Satterthwaite | 384/130 |
| 3,912,342 | 10/1975 | Schirm et al. | 384/131 |
| 3,930,691 | 1/1976 | Greene . | |
| 4,268,094 | 5/1981 | Greene | 384/107 |
| 4,389,052 | 6/1983 | Shimizu et al. | 277/67 |
| 4,477,223 | 10/1984 | Giroux | 415/111 X |
| 4,543,038 | 9/1985 | Kitaguchi | 415/112 |
| 4,783,179 | 11/1988 | Katayama et al. | 384/131 X |

*Primary Examiner*—Thomas R. Hannon

*Attorney, Agent, or Firm*—David W. Tibbott

[57] ABSTRACT

A centrifugal pump of the type specially adapted to be used as a boiler feed pump and including a bearing system at the driven end of the pump comprising a bearing chamber housing a flexible bearing supporting the pump shaft and being cooled by the fluid that is being pumped which is fed to the bearing through passages in the pump casing. The pump further includes controlled leakage seals located at each end of the bearing and adapted to leak the cooling fluid at controlled rates into both the chamber housing the pump impeller and a fluid collection chamber. The leakage into the fluid collection chamber is withdrawn and reused in the usual manner. The pump shaft engages additional seals which serve to prevent the pump cooling fluid from leaking to the outside of the pump.

4 Claims, 3 Drawing Sheets

PUMP BEARING SYSTEM

BACKGROUND OF THE INVENTION

This invention relates generally to centrifugal pumps and more particularly to a bearing system for centrifugal pumps handling hot fluids such as a boiler feed pump.

Prior art boiler feed pumps normally contain both a controlled leakage seal system and a separate lubricated bearing system at the driven end of the pump, where the driven shaft of the pump penetrates the pump casing. Generally the controlled leakage seal system is fed cooled fluid, of the same type as handled by the pump, wherein the cooled fluid cools the seal and prevents the hot fluid in the pump from damaging the seal while any cooling fluid that reaches the interior of the pump mixes with the pumped fluid without contamination problems. The separate bearing system is located out of the chamber containing the controlled leakage seal system and is lubricated by a separate oil lubricating system. This arrangement makes the driven end of the pump longer, adding weight to the pump casing and, causing the pump to be more expensive.

The foregoing described problems are known to exist in centrifugal pumps in use today. It is apparent that it would be advantageous to provide an alternative directed to overcoming the limitations set forth above. Accordingly, a suitable alternative is provided including features more fully disclosed hereinafter.

SUMMARY OF THE INVENTION

In the present invention, the controlled leakage seal system and the lubricated bearing system are combined into one system using a bearing lubricated by the sealing fluid which also happens to be the same fluid that is handled by the pump. By combining the seal and bearing systems the driven end of the pump becomes shorter resulting in a reduction of weight and cost.

The foregoing and other aspects will become apparent in the following detailed description of the invention when considered in conjunction with the accompanying drawing figures.

BRIEF DESCRIPTION OF THE DRAWING FIGURES

DETAILED DESCRIPTION

Figure 1:
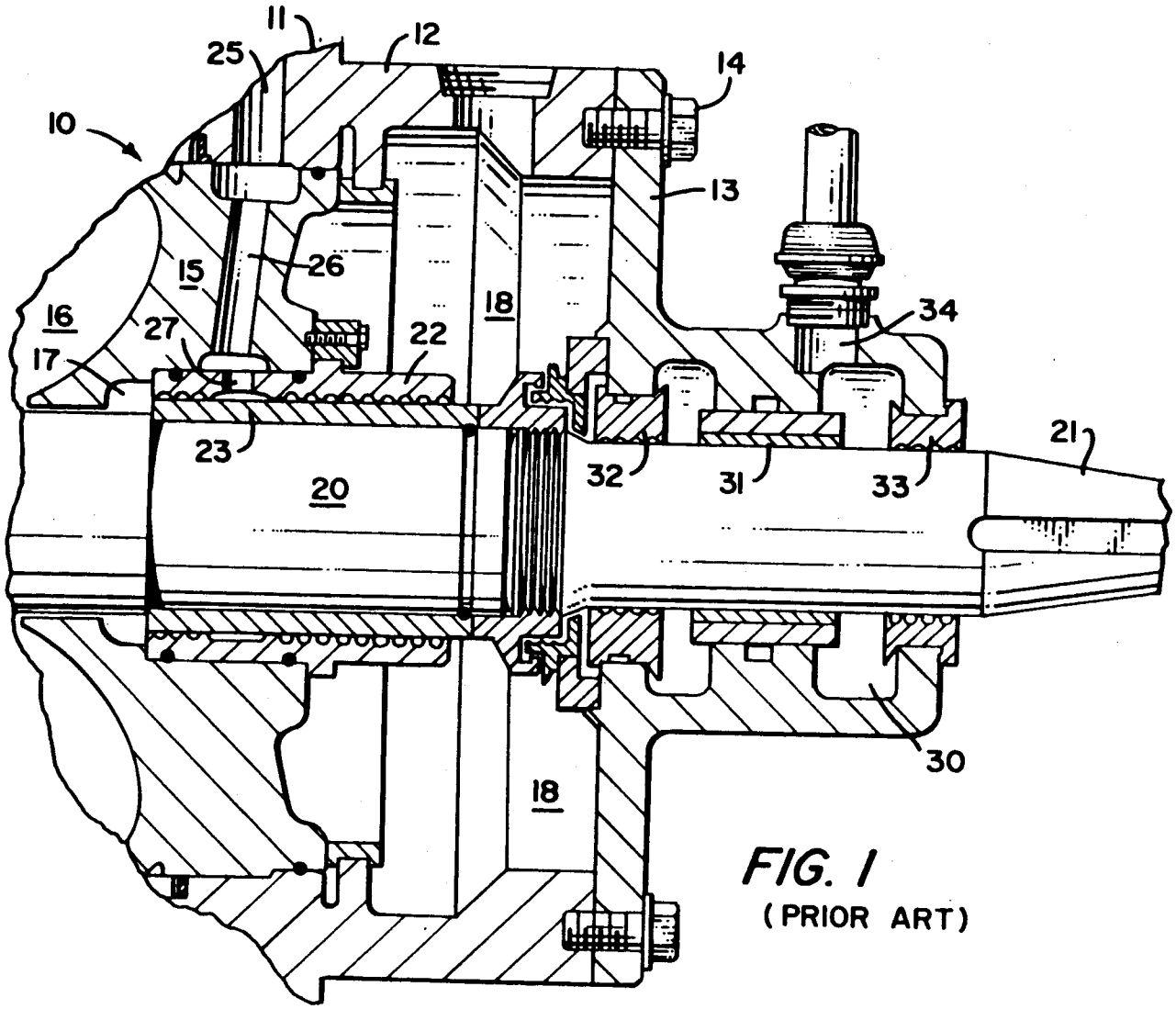
FIG. 1 (PRIOR ART)
FIG. 1 is an axial section of the driven end portion of a prior art boiler feed pump containing a controlled leakage seal system and a separate lubricated bearing system.

FIG. 1 illustrates the driven end of a conventional boiler feed pump 10. The portion of the pump 10 shown in FIG. 1 includes a casing 11 having a casing end 12 and a casing end plate 13 bolted to the casing end 12 by conventional bolts 14. An internal pump partition 15, located in the casing 11, separates a pumping chamber 16 from a sealing chamber 17. Also shown is a sealing fluid collection chamber 18 formed between the partition 15 and the end plate 13. A pump shaft 20 is shown passing through the casing end plate 13 and the internal partition 15.

The internal end of the shaft 20 is connected to one or more pump impellers (not shown), one of which is in the pumping chamber 16. The driven end 21 of the shaft 20 is adapted to be connected to a driver (not shown), which can be an electric motor or an internal combustion engine.

The sealing chamber 17 contains a conventional seal 22 of the gland type engaging a sleeve 23 mounted on the shaft 20. A cooling fluid passage 25 is located in the casing end 12 and communicates with a second passage 26 located in the partition 15. The inner end of the passage 26 opens into a port 27 located in the seal 22. The cooling fluid flows through the passages 25, 26 and port 27 to cool the seal 22. The cooling fluid after passing through the port 27 travels in both directions in the seal with some entering the pumping chamber 16 where it mixes with the pumped fluid and with some passing through the seal into the collection chamber 18 where it eventually drains back to a collection system for reuse.

The end plate 13 attached to the casing end 12 contains a bearing chamber 30, which houses a journal bearing sleeve 31 circling the shaft 20 and supporting the same for rotation in the casing. Seals 32 and 33 are located in the bearing chamber 30 on the opposite ends of the bearing sleeve 31 where they circle the shaft 20 and seal leakage from the bearing chamber 30. The port 34 located on the end plate 13 serves to feed lubricating oil into the bearing chamber 30 for lubricating the bearing sleeve 31 and the adjacent surface of the shaft 20. All of the foregoing structure is conventional and well known in the pump art.

The invention in this application is the concept of combining the bearing system and the controlled leakage seal system into one unit or system in order to shorten the en of the pump, thereby providing obvious benefits including a reduction in the size, weight and cost of the pump.

Figure 2:
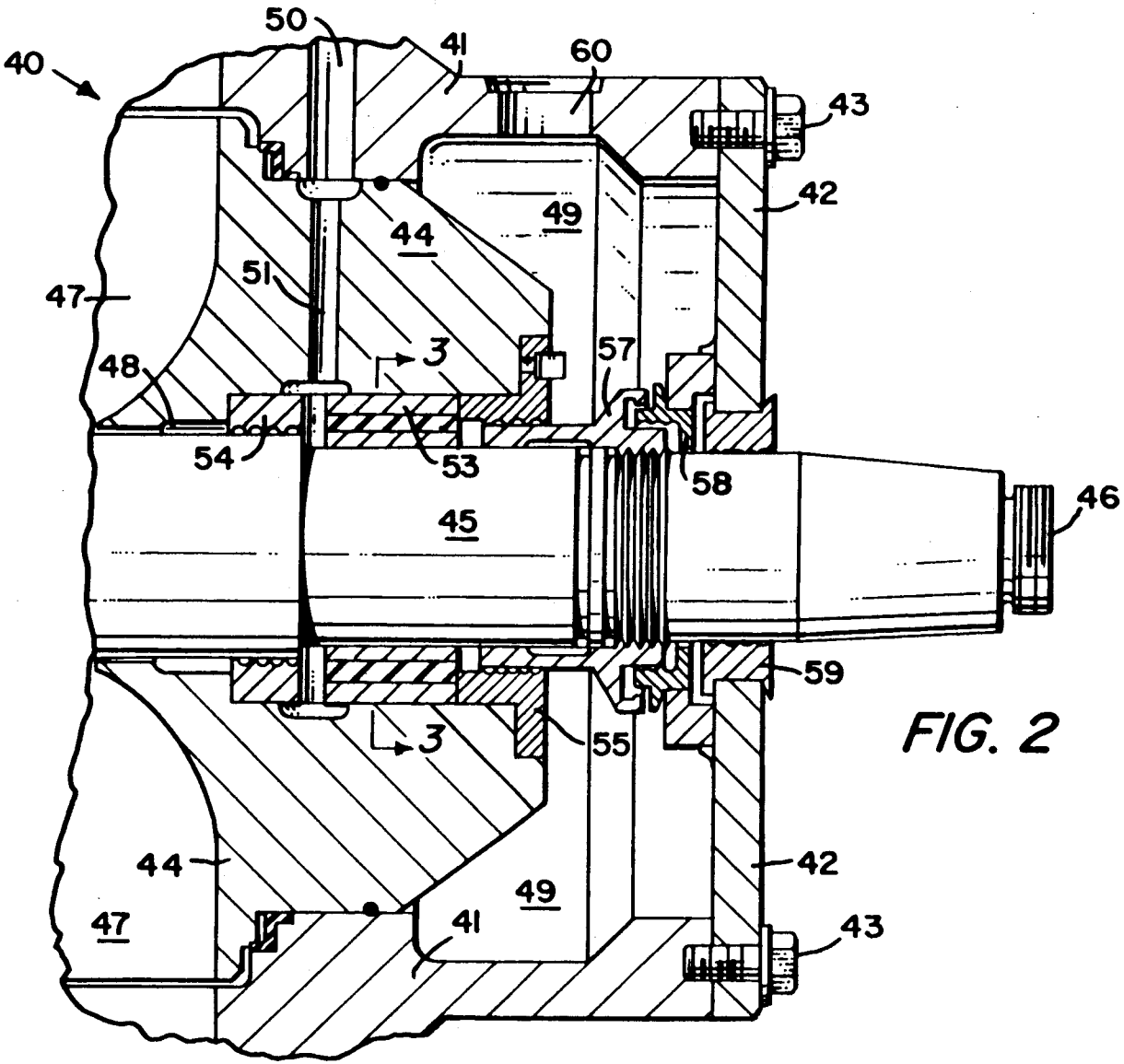
FIG. 2 is an axial section similar to FIG. 1 showing a boiler feed pump containing the bearing system forming this invention.

FIG. 2 illustrates an embodiment of a boiler feed pump incorporating the principles of this invention. FIG. 2 shows a pump 40 including a casing end 41, a casing end plate 42 attached to the casing end 41 by bolts 43 and containing an internal partition 44 and a shaft 45 with a driven end 46. The pump 40 further includes a pumping chamber 47 for holding an impeller (not shown) mounted on the shaft 45, a seal-bearing chamber 48 and a fluid collection chamber 49. Cooling fluid for the bearing seal chamber 48 flows through a passage 50 in the casing end 41, an interconnected passage 51 in the partition 44 and into the bearing seal chamber 48.

The bearing seal chamber 48 contains a bearing 53 encircling the shaft 45. The bearing 45 is a special type of bearing, sometimes referred to as a flexible pad bearing, which can flex slightly in order to accommodate itself to the surface of the shaft 45 and to support the shaft in a more highly loaded condition than normally possible with a conventional journal type bearing. An example of this type of bearing is shown in U.S. Pat. No. 4,268,094, issued May 19, 1981, to Jerome Green, and is referred to in this patent as a "hydrodynamic bearing". This type of bearing can use water as a lubricant, as well as other fluids of similar nature and viscosity. Consequently this type of bearing can use as a lubricant the fluid that is normally handled (pumped) by a boiler feed pump.

Also housed in the combination seal-bearing chamber 48 is a forward seal 54 controlling the leakage of the cooling fluid into the pumping chamber 47 and a rear seal 55 controlling the leakage of the cooling fluid into the fluid collection chamber 49. Also mounted on the shaft 45 is a sleeve 57 engaging the seal 55 and cooperating with it to provide a sealing condition. The rear end of the sleeve 57 further cooperates with a face seal 58 to control the leakage from the fluid collection chamber 49 to the outside of the pump. An additional seal 59 is mounted in the end plate 42 engaging the shaft 45 for additional sealing purposes.

The fluid collection chamber includes a port 60 for conveying fluid from the chamber to a collection system where it can be used further. It is understood that cooling fluid is introduced through the passages 50 and 51 into the seal-bearing chamber 48 where it serves as a lubricant for the bearing 55 as well as cooling the seals 54 and 55 in the same manner as in the prior art pump.

Figure 3:
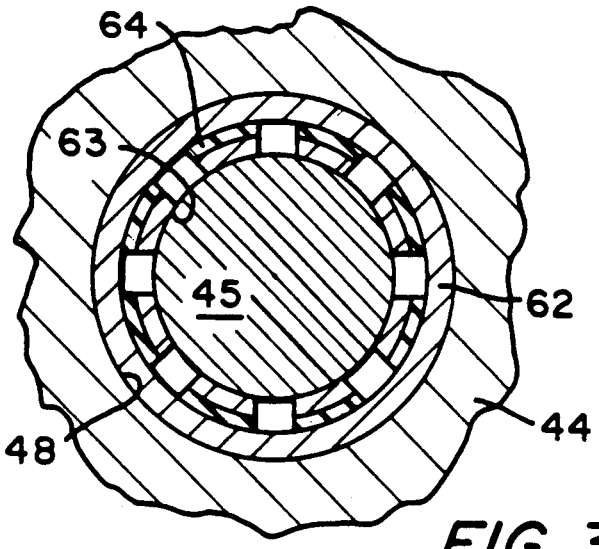
FIG. 3 is a cross-section taken on line 3—3 in FIG. 2 illustrating details of the bearing.

FIG. 3 illustrates the bearing 53. In general, it includes an outer sleeve 62 fitted into the seal-bearing chamber 48, seated within the annular walls of the chamber 48, and a series of bearing pads 63 located around and engaging the shaft 45 in a bearing relationship. The bearing pads 63 are supported on flexible layers 64 interconnecting the pads 63 to the interior of the sleeve 62. The flexible layers 64 allow the pads 63 to move independently of each other which allows them to support the shaft 45 in a more highly loaded condition than possible with conventional journal bearings.

While this invention has been illustrated and described in connection with a preferred embodiment, it is recognized that variations and changes may be made therein without departing from the invention as set forth in the claims.

Having described the invention, what is claimed is:

1. A bearing system for a centrifugal pump comprising: a pump casing have a pumping chamber and a separate bearing chamber; a pump shaft extending through the bearing chamber into the pumping chamber and having an end located outside of the pump casing adapted to be driven and the other end connected to a pump impeller for rotation inside of the pumping chamber for pumping fluid; bearing means inside of said bearing chamber for supporting said shaft for rotation; first seal means separating said bearing chamber from said pumping chamber and second seal means separating said bearing chamber from the outside of the pump casing, said first seal means being adapted to restrict the leakage of the pumped fluid from said pumping chamber into said bearing chamber while allowing some leakage; and means for admitting a portion of the pumped fluid to said bearing chamber to cool the sealing means and to lubricate the bearing, whereby any fluid leaking from the bearing chamber into the pumping chamber mixes with the pumped fluid without contaminating the pumped fluid.

2. The bearing system of claim 2 wherein said pump includes a fluid collection chamber located in said casing adjacent said shaft and between said bearing chamber and the other end of said shaft for collecting fluid leaking from said bearing chamber.

3. The bearing system of claim 2 wherein said bearing chamber and said fluid collection chamber are separated by a controlled leakage seal intended to allow pumped fluid to pass from the bearing chamber to the fluid collection chamber at a controlled rate.

4. The bearing system of claim 1 wherein said bearing is of the type including a plurality of flexibly mounted pads spaced around the periphery of the shaft and is adapted to be lubricated by the pumped fluid.

* * * * *